US009349520B2

(12) United States Patent
Demetriou et al.

(10) Patent No.: US 9,349,520 B2
(45) Date of Patent: May 24, 2016

(54) FERROMAGNETIC CORES OF AMORPHOUS FERROMAGNETIC METAL ALLOYS AND ELECTRONIC DEVICES HAVING THE SAME

(75) Inventors: Marios D. Demetriou, Los Angeles, CA (US); William L. Johnson, San Marino, CA (US); Xiao Liu, Pasadena, CA (US); Joseph P. Schramm, Albany, CA (US); Georg Kaltenboeck, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 209 days.

(21) Appl. No.: 13/884,926

(22) PCT Filed: Nov. 9, 2011

(86) PCT No.: PCT/US2011/060026

§ 371 (c)(1), (2), (4) Date: Oct. 28, 2013

(87) PCT Pub. No.: WO2012/064871

PCT Pub. Date: May 18, 2012

(65) Prior Publication Data

US 2014/0043132 A1 Feb. 13, 2014

Related U.S. Application Data

(60) Provisional application No. 61/411,785, filed on Nov. 9, 2010.

(51) Int. Cl.

| | |
|---|---|
| ***H01F 27/24*** | (2006.01) |
| ***H01F 3/10*** | (2006.01) |
| ***H01F 41/02*** | (2006.01) |

(52) U.S. Cl.
CPC ..... *H01F 27/24* (2013.01); *H01F 3/10* (2013.01); *H01F 41/0206* (2013.01); *Y10T 29/49075* (2015.01)

(58) Field of Classification Search
CPC .... H01F 27/2455; H01F 27/24; H01F 27/245
USPC ..... 336/211, 233, 212
See application file for complete search history.

(56) References Cited

U.S. PATENT DOCUMENTS

| | | | | |
|---|---|---|---|---|
| 4,130,862 | A | 12/1978 | Holt | |
| 4,520,335 | A * | 5/1985 | Rauch et al. | 336/212 |
| 4,528,481 | A * | 7/1985 | Becker et al. | 315/248 |

(Continued)

FOREIGN PATENT DOCUMENTS

| | | |
|---|---|---|
| JP | 5940503 | 3/1984 |
| WO | 2012064871 A2 | 5/2012 |

OTHER PUBLICATIONS

Decristofaro, "Amorphous Metals in Electric-Power Distribution Applications", MRS Bulletin, May 1998, pp. 50-56.

*Primary Examiner* — Tsz Chan
(74) *Attorney, Agent, or Firm* — KPPB LLP

(57) ABSTRACT

Ferromagnetic cores made from amorphous glasses and methods of forming ferromagnetic cores from metallic glasses are provided. The method forms a magnetic core from a section of a series of concentrically nested ferromagnetic tubes formed of an amorphous metallic material having a Curie-point temperature above room temperature and demonstrating soft ferromagnetic properties, thereby simplifying the manufacturing process and improving the electrical and mechanical performance of the core itself.

21 Claims, 10 Drawing Sheets

(56) References Cited

U.S. PATENT DOCUMENTS

| | | | | |
|---|---|---|---|---|
| 4,648,929 | A | 3/1987 | Siman | |
| 4,734,975 | A | 4/1988 | Ballard et al. | |
| 4,983,943 | A | 1/1991 | Murata et al. | |
| 5,086,554 | A | 2/1992 | Murata et al. | |
| 5,091,253 | A | 2/1992 | Smith et al. | |
| 5,261,152 | A | 11/1993 | Simozaki et al. | |
| 5,288,344 | A | 2/1994 | Peker et al. | |
| 5,368,659 | A | 11/1994 | Peker et al. | |
| 5,528,205 | A | 6/1996 | Wong | |
| 5,618,359 | A | 4/1997 | Lin et al. | |
| 5,735,975 | A | 4/1998 | Lin et al. | |
| 5,961,745 | A * | 10/1999 | Inoue et al. | 148/304 |
| 6,331,363 | B1 | 12/2001 | DeCristofaro et al. | |
| 6,507,262 | B1 | 1/2003 | Otte et al. | |
| 6,873,239 | B2 | 3/2005 | Decristofaro et al. | |
| 7,017,645 | B2 | 3/2006 | Johnson et al. | |
| 7,166,795 | B2 | 1/2007 | Lengeling | |
| 7,583,500 | B2 | 9/2009 | Ligtenberg et al. | |
| 7,708,844 | B2 | 5/2010 | Muramatsu et al. | |
| 7,883,592 | B2 | 2/2011 | Hofmann et al. | |
| 2002/0145416 | A1 * | 10/2002 | Attarian et al. | 324/127 |
| 2004/0085174 | A1 * | 5/2004 | Decristofaro et al. | 336/178 |
| 2006/0170524 | A1 * | 8/2006 | Fujiwara et al. | 336/83 |
| 2007/0175545 | A1 | 8/2007 | Urata et al. | |
| 2009/0236017 | A1 | 9/2009 | Johnson et al. | |
| 2010/0188186 | A1 * | 7/2010 | Urata et al. | 336/233 |
| 2010/0300148 | A1 | 12/2010 | Demetriou et al. | |
| 2011/0079940 | A1 | 4/2011 | Schroers et al. | |

* cited by examiner

FERROMAGNETIC CORES OF AMORPHOUS FERROMAGNETIC METAL ALLOYS AND ELECTRONIC DEVICES HAVING THE SAME

CROSS-REFERENCE TO RELATED APPLICATIONS

This application claims priority to U.S. Provisional Application No. 61/411,785, filed Nov. 9, 2010, the disclosures of which are incorporated herein by reference.

FIELD OF THE INVENTION

This invention relates generally to magnetic cores; and more particularly to tubes of hierarchically varying diameters made of ferromagnetic metallic glasses that can be concentrically nested and sectioned to form magnetic cores of various shapes and dimensions.

BACKGROUND OF THE INVENTION

Electrical transformers are necessary components in many widely-used energy conversion systems, and, as a result, engineers and scientists are continuously striving to increase the efficiency of these conversion systems. Since the discovery of amorphous metal alloys with Curie-point temperatures above room temperature in the early 1970's, one significant improvement in efficiency has been the use of cores fabricated of extremely thin laminations of amorphous ferromagnetic strips. (See, e.g., U.S. Pat. No. 5,331,304, the disclosure of which is incorporated herein by reference.) The use of amorphous magnetic materials provides improved magnetic characteristics resulting from the inherently lower electrical losses generated by these materials. Because of the absence of a crystal lattice, the magnetic moment in amorphous ferromagnets is not coupled to a particular structural direction, so there is no magneto-crystalline anisotropy. Moreover, since the material is magnetically homogeneous at length scales comparable to the magnetic correlation length, the intrinsic coercivity is small. Consequently, amorphous ferromagnetic cores exhibit soft magnetic behavior characterized by high saturation magnetization, desirable for higher power cores with smaller sizes, low coercivity, low magnetic remanence, and small hysteresis, all of which lead to very low core losses and high efficiencies. Accordingly, amorphous ferromagnetic cores offer improved magnetic coupling characteristics over comparable cores fabricated, for example, of crystalline ferromagnetic alloys.

Amorphous materials are a relatively new class of engineering material, which have a unique combination of high strength, elasticity, corrosion resistance and processability from the molten state. Amorphous materials differ from conventional crystalline alloys in that their atomic structure lacks the typical long-range ordered patterns of the atomic structure of conventional crystalline alloys. Amorphous materials are generally processed and formed by cooling a molten alloy from above the melting temperature of the crystalline phase (or the thermodynamic melting temperature) to below the "glass transition temperature" of the amorphous phase at "sufficiently fast" cooling rates, such that the nucleation and growth of crystals is avoided. As such, the processing methods for amorphous alloys have always been concerned with quantifying the "sufficiently fast cooling rate", which is also referred to as "critical cooling rate", to ensure formation of the amorphous phase.

The "critical cooling rates" for early amorphous materials were extremely high, on the order of $10^{6}$° C./s. As such, conventional casting processes were not suitable for such high cooling rates, and special casting processes such as melt spinning and planar flow casting were developed. Due to the crystallization kinetics of those early alloys being substantially fast, extremely short time (on the order of $10^{-3}$ seconds or less) for heat extraction from the molten alloy was required to bypass crystallization, and thus early amorphous alloys were also limited in size in at least one dimension. For example, only very thin foils and ribbons (order of 25 microns in thickness) were successfully produced using these conventional techniques. Because the critical cooling rate requirements for these amorphous alloys severely limited the size of parts made, the use of early amorphous alloys as bulk objects and articles was limited.

Accordingly, conventional amorphous ferromagnetic cores are typically manufactured in continuous strips or ribbons of about 0.001 inch thickness. Cores were produced by concentrically laminating these ribbons around a mandrel forming cores of desired shapes and sizes. Although successful, this process is inherently laborious and expensive. Moreover, cores fabricated of such strips or ribbons usually demonstrate poor fracture toughness. Consequently, such amorphous ferromagnetic cores are subject to easy fracture and great care must be taken in the handling of a core of an electrical transformer fabricated of an amorphous metal in order to minimize undesired fracturing of the amorphous metal laminations of the core. As a result, various arrangements have been proposed for restricting the flexing of the laminations of the amorphous material in order to minimize the fracture mechanism. (See, e.g., U.S. Pat. No. 4,734,975). But fracture is not the only failure mode associated with poor toughness. Fatigue, arising from cyclic loading due to core vibrations during operation, is another failure mode associated with low toughness. Hence, a need exists for amorphous ferromagnetic cores exhibiting higher inherent fracture toughness.

Yet another problem in the fabrication of prior art wound amorphous metal cores is the necessity of maintaining the relative positions of the amorphous metallic strips after winding as closely as possible to their positions. Incorrect replacement of the displaced core ends during the winding procedure can result in large air gaps between the strips and/or significant mechanical stresses within the amorphous metal thereby impairing magnetic performance of the core, and compromising the low core loss characteristics of the amorphous material. Even with careful winding, the packing efficiency of the cores is still lower than the density of the monolithic amorphous metals, which adversely influences the performance of the core in reference to a monolithic core made of a bulk amorphous metal.

Over the years it was determined that the "critical cooling rate" depends strongly on the chemical composition of amorphous alloys. Accordingly, a great deal of research was focused on developing new alloy compositions with much lower critical cooling rates. Examples of these alloys are given in U.S. Pat. Nos. 5,288,344; 5,368,659; 5,618,359; and 5,735,975, each of which is incorporated herein by reference. These amorphous alloy systems, also called bulk-metallic glasses or BMGs, are characterized by critical cooling rates as low as a few ° C./s, which allows the processing and forming of much larger bulk amorphous phase objects than were previously achievable.

In addition to the alloy systems disclosed in the inventions listed above, other inventions were directed to alloy compositions capable of forming bulk ferromagnetic glasses at relatively low cooling rates. For example, US Pat. App. No. 2010/0300148 is directed to bulk amorphous alloys of composition (Fe,Co,Ni)—Mo—(C,B)—(P,Si) that exhibit good glass-forming ability and soft magnetic properties. Additionally, the alloys of that prior art demonstrate high inherent toughness, and thus have the potential to overcome the fracture and fatigue problems encountered in cores fabricated of micrometer-thick amorphous laminae.

Accordingly, a need exists to find a novel approach to fabricate cores from thicker laminae made of bulk ferromagnetic alloys with thicknesses of at least 0.5 mm.

BRIEF SUMMARY OF THE INVENTION

In accordance with the current invention, there are provided ferromagnetic cores and methods of forming such cores.

In some embodiments, the invention is directed to a ferromagnetic core including a plurality of tubes of hierarchically varying diameters and wall thickness of at least 0.5 mm, the tubes being bonded together concentrically to form a nested hollow cylinder, and being formed of an amorphous metal alloys having a Curie-point temperature above room temperature.

In one such embodiment, the core is a section of the nested hollow cylinder taken perpendicular to the central axis of the cylinder such that core has a cylindrical geometry.

In another such embodiment, the core is a plurality of sections of the nested hollow cylinder taken at an angle to the central axis of the cylinder. In one such embodiment, the plurality of sections are bonded together to form a unitary core having a tubular cross-section. In another such embodiment, the plurality of sections are taken at an angle of 45 degrees to the central axis core to form a unitary core having a tubular cross-section and a geometry selected from the group consisting of U-shaped, E-shaped, C-shaped, and I-shaped, or combinations thereof.

In still another such embodiment, the alloy includes at least one metal selected from the group consisting of Fe, Co and Ni. In one such embodiment, the alloy contains B, and at least one of Si and P. In another such embodiment, the alloy also contains at least one of Mo and Nb. In yet another such embodiment, the alloy comprises at least 60 atomic percent of at least one metal selected from the group consisting of Fe, Co and Ni. In yet another such embodiment, the alloy has a composition selected from the group consisting of $Fe_{70}Ni_5Mo_5P_{12.5}C_5B_2$, $Fe_{69}Ni_4CO_2Mo_5P_{12.5}C_5B_{2.5}$, $Fe_{68}Ni_2Co_5Mo_5P_{12.5}C_5B_{2.5}$, $Fe_{73}Ni_3Mo_4P_{11.5}C_5B_{2.5}Si_1$, and $Fe_{68}Ni_3Co_5Mo_4P_{11.5}C_5B_{2.5}Si_1$.

In yet another such embodiment, the alloy exhibits a saturation magnetization of at least 1 T.

In still yet another such embodiment, the alloy exhibits a coercive field of less than 500 A/m.

In still yet another such embodiment, the alloy exhibits a remanent magnetization of less than 0.001 T.

In still yet another such embodiment, the alloy exhibits notch toughness, measured by bending a 2 mm diameter rod containing a notch with length of about 1 mm and root radius of about 0.1 mm, of at least 40 $MPa \cdot m^{1/2}$.

In still yet another such embodiment, the tubes are bonded together with an epoxy resin.

In other embodiments the invention is directed to a method of forming a ferromagnetic core including:

forming a plurality of tubes of hierarchically varying diameters and wall thickness of at least 0.5 mm of an amorphous metal alloys having a Curie-point temperature above room temperature;

bonding the tubes together concentrically to form a nested hollow cylinder; and sectioning the cylinder to form a core having a tubular cross-section.

In one such embodiment, the cylinder is sectioned perpendicular to the central axis of the cylinder such that core has a cylindrical geometry.

In another such embodiment, the cylinder is sectioned at an angle to the central axis of the cylinder. In one such embodiment a plurality of sections are taken from the cylinder and the plurality of sections are bonded together to form a unitary core having a tubular cross-section. In still another such embodiment, the cylinder is sectioned at an angle of 45 degrees to the central axis core, and the plurality of sections are bonded to form a unitary core having a tubular cross-section and a geometry selected from the group consisting of U-shaped, E-shaped, C-shaped, and I-shaped, or combinations thereof.

In still another such embodiment, the alloy includes at least one metal selected from the group consisting of Fe, Co and Ni. In one such embodiment, the alloy contains B, and at least one of Si and P. In another such embodiment, the alloy also contains at least one of Mo and Nb. In yet another such embodiment, the alloy comprises at least 60 atomic percent of at least one metal selected from the group consisting of Fe, Co and Ni. In yet another such embodiment, the alloy has a composition selected from the group consisting of $Fe_{70}Ni_5Mo_5P_{12.5}C_5B_2$, $Fe_{69}Ni_4Co_2Mo_5P_{12.5}C_5B_{2.5}$, $Fe_{68}Ni_2Co_5Mo_5P_{12.5}C_5B_{2.5}$, $Fe_{73}Ni_3Mo_4P_{11.5}C_5B_{2.5}Si_1$, and $Fe_{68}Ni_3Co_5Mo_4P_{11.5}C_5B_{2.5}Si_1$.

In yet another such embodiment, the alloy exhibits a saturation magnetization of at least 1 T.

In still yet another such embodiment, the alloy exhibits a coercive field of less than 500 A/m.

In still yet another such embodiment, the alloy exhibits a remanent magnetization of less than 0.001 T.

In still yet another such embodiment, the alloy exhibits notch toughness, measured by bending a 2 mm diameter rod containing a notch with length of about 1 mm and root radius of about 0.1 mm, of at least 40 $MPa \cdot m^{1/2}$.

In still yet another such embodiment, the tubes are bonded together with an epoxy resin.

In still other embodiments, the invention is directed to a consumer electronics device incorporating a ferromagnetic core, the core including a plurality of tubes of hierarchically varying diameters and wall thickness of at least 0.5 mm, the tubes being bonded together concentrically to form a nested hollow cylinder, and being formed of an amorphous metal alloys having a Curie-point temperature above room temperature.

In one such embodiment, the consumer electronic device is configured to at least generate, transmit or convert electrical power In another such embodiment, the consumer electronic device is one of chargers, music players, video players, still image players, game players, other media players, music recorders, video recorders, cameras, other media recorders, radios, medical equipment, calculators, cellular phones, other wireless communication devices, personal digital assistances, programmable remote controls, pagers, laptop computers, printers, or combinations thereof.

BRIEF DESCRIPTION OF THE DRAWINGS

The description will be more fully understood with reference to the following figures, which are presented as exemplary embodiments of the invention and should not be construed as a complete recitation of the scope of the invention, wherein.

DETAILED DESCRIPTION OF THE INVENTION

Figure 1A:
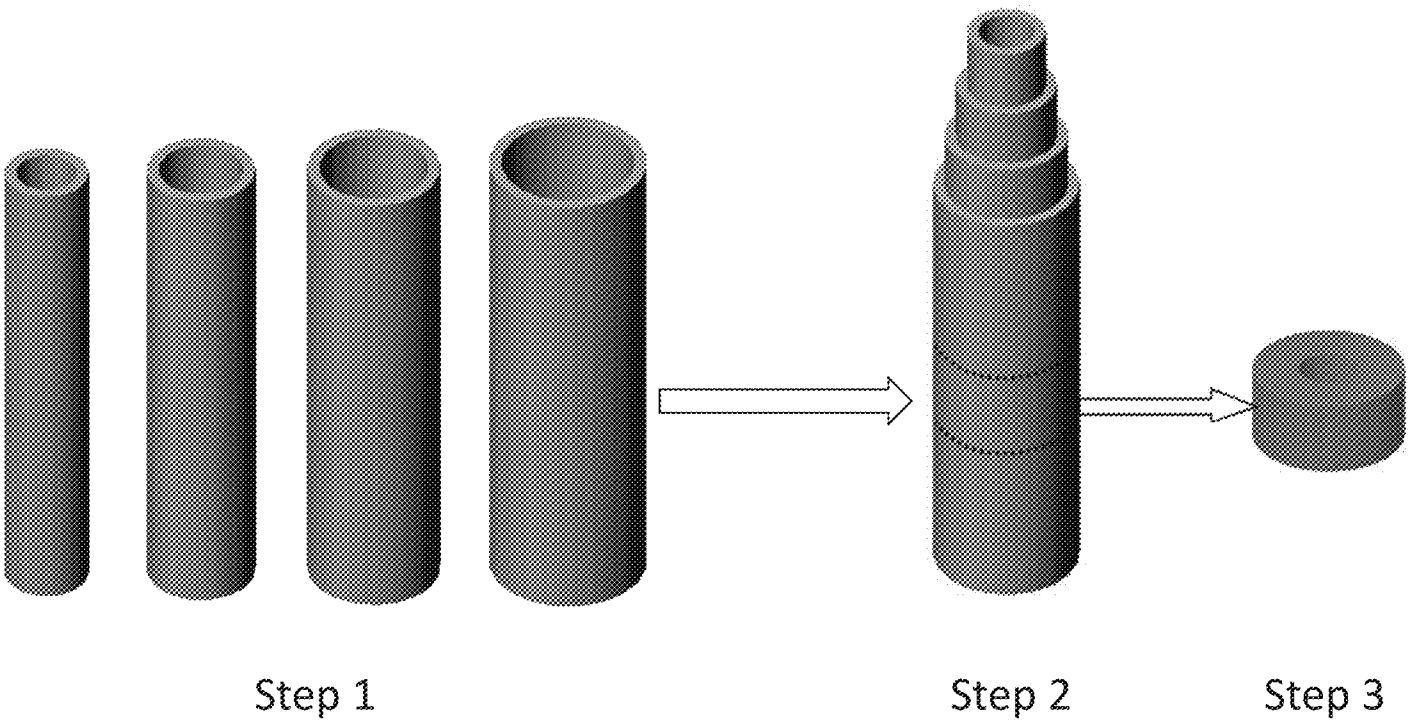
FIG. 1A provides a flow chart of an exemplary ferromagnetic core forming method and a schematic of an exemplary embodiment of a ferromagnetic core in accordance with the current invention.
Figure 1B:
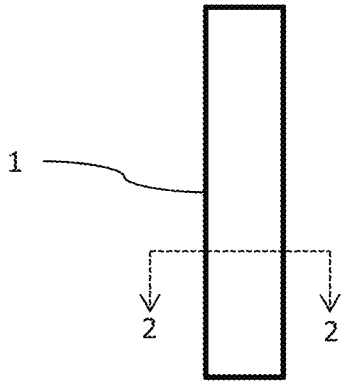
FIGS. 1B to 1F provide: (B) a "I" shape core; (C) a cross-sectional view of FIG. 1B; (D) a "C" shape core in cross-section; (E) a "U" shape core; and (F) an "E" shape core.

The current invention is directed to ferromagnetic cores made from metallic glasses and methods of forming ferromagnetic cores from metallic glasses. More specifically, the method is directed to a magnetic core fabricated by concentrically nesting ferromagnetic tubes formed of an amorphous metallic material having a Curie-point temperature above room temperature and demonstrating soft ferromagnetic properties, thereby simplifying the manufacturing process and improving the electrical and mechanical performance of the core itself.

Generally, a magnetic core is a piece of magnetic material with a high permeability used to confine and guide magnetic fields in electrical, electromechanical and magnetic devices such as electromagnets, transformers, electric motors, inductors and magnetic assemblies. It is typically made of a ferromagnetic metal such as iron, or ferromagnetic compounds such as ferrites. The high permeability, relative to the surrounding air, causes the magnetic field lines to be concentrated in the core material. The magnetic field is often created by a coil of wire around the core that carries a current. The presence of the core can increase the magnetic field of the coil by a factor of several thousand over what it would be without the core.

Accordingly, the use of a magnetic core can enormously concentrate the strength and increase the effect of magnetic fields produced by electric currents and permanent magnets. The properties of such a device depend crucially on the following factors:

- the properties of the core material (especially permeability and hysteresis); and
- the geometry of the magnetic core.

It is typically undesirable for the core to retain magnetization when the applied field is removed. This property, called hysteresis, can cause energy losses in applications such as inductors or transformers. Therefore 'soft' magnetic materials with low hysteresis, such as silicon steel, rather than the 'hard' magnetic materials used for permanent magnets, are usually used in cores. As previously described, it has long been known that amorphous materials have excellent soft magnetic properties for such applications. (See, e.g., DeCristofaro, N., *MRS Bulletin*, 23:5 (1998) p50-56, the disclosure of which is incorporated herein by reference.) However, in the current invention there is an additional limitation that the metallic glass is capable of forming an amorphous phase in objects with bulk dimensions (i.e., objects with dimensions of >1 mm). Exemplary bulk forming ferromagnetic amorphous alloys are disclosed in US Pat. App. No. 2010/0300148, the disclosure of which is incorporated herein by reference. Also, the metallic glass should exhibit relatively high toughness such that it can resist fracture and fatigue. Accordingly, for the purposes of the instant invention the metallic glass should be chosen such that it has soft magnetic properties (i.e., a Curie temperature above room temperature, a saturation magnetization of 1 T or higher, a coercive field of 500 A/m or lower, a remanent magnetization of 0.001 T or lower), the ability to form objects with bulk dimensions (i.e., dimensions of greater than 1 mm and preferably up to 6 mm), and relatively high toughness (notch toughness of at least 40 $MPa \cdot m^{1/2}$, and preferably of up to 60 $MPa \cdot m^{1/2}$)

Some exemplary soft ferromagnetic glass alloys in accordance with embodiments of the invention comprise Fe, Co or Ni, or combinations thereof. In a preferred embodiment, the atomic fractions of Fe, Co, or Ni, or their combinations form at least 60% of the soft ferromagnetic glass alloys. Metallic glasses of this sort may further contain B, and at least one of Si or P. Such metallic glasses may also contain at least one of Mo and Nb. Some specific embodiments of soft ferromagnetic glass alloys that are suitable include, for example, $Fe_{70}Ni_5Mo_5P_{12.5}C_5B_2$, $Fe_{69}Ni_4Co_2Mo_5P_{12.5}C_5B_{2.5}$, $Fe_{68}Ni_2CO_5Mo_5P_{12.5}C_5B_{2.5}$, $Fe_{73}Ni_3Mo_4P_{11.5}C_5B_{2.5}Si_1$, or $Fe_{6.5}Ni_3Co_5Mo_4P_{11.5}C_5B_{2.5}Si_1$.

Turning to the geometry of the magnetic core, as described above and in the prior art, conventional amorphous metal magnetic cores are formed of ferromagnetic glass ribbons that have been rolled on a mandrel, laminated with epoxy, and finally sectioned. An example of such a method is described in U.S. Pat. Nos. 4,648,929 and 5,261,152, the disclosures of which are incorporated herein by reference. These circular windings can then be trimmed into a variety of shapes such as "C", "U", "I", and "E" shaped cores. Examples of these are described in U.S. Pat. No. 6,873,239, the disclosure of which is incorporated herein by reference. The reason for this concentric geometry is that such a geometry has been found to be effective in mitigating the adverse effects of eddy currents on the performance of the cores.

Accordingly, as shown in FIG. 1A, the geometry of the cores of the instant invention are formed from a plurality of concentrically nested tubes made of soft ferromagnetic glass materials. More particularly, the cores in accordance with the invention are in the form of a plurality of high-precision hollow tubes with wall thicknesses of at least 0.5 mm and no greater than the critical thickness for glass formation, having hierarchically varying diameters such that they can be nested concentrically to form thicker tubes of any desirable dimensions. Such a construction of nested tubes will yield soft ferromagnetic cores similar to those formed by laminating micrometer-thick ribbons. Moreover, the concentric geometry of the nested tubes will have an analogous effect in mitigating the adverse effects of eddy currents in those cores.

Turning to the manufacture of these tubes (Step 1 in FIG. 1A) of hierarchically varying dimensions, and their combination into a concentrically nested core, it should be understood that any suitable manufacturing technique may be used that is capable of forming tubes of sufficient precision and sufficient bulk dimension. Examples of techniques include casting, molding, blow molding, forging, rapid capacitor discharge forming, thermoplastic casting, etc. In preferred embodiments, the hollow tubes can be formed by any of the following rapid cooling methods:

Water quenching concentric quartz tubes containing molten alloy; and

Injection/suction/tilt casting over copper/bronze/steel mold tools.

Further details of some exemplary techniques may be found in U.S. Pat. Nos. 7,017,645; 7,708,844 and 7,883,592, and in U.S. Patent Publication Nos. 2009/0236017 and 2011/0079940, the disclosures of each of which are incorporated herein by reference.

Forming amorphous tubes from the melt is not an easy task, as the entrapped residual stresses in a tubular geometry resolve into tensile stresses, thereby subjecting the material to tension and the risk of fracture upon quenching. Moreover, ejecting molded tubes from tubular cavities is extremely difficult task. One skilled in the art may find it beneficial to instead form partial tube segments from the melt rather than whole tubes, and unite the individual partial tube segments t form whole tubes. Such tube segments may be in the form of half tubes or quarter tubes, and may be joined together by means of adhesives or snap fits, it should be understood that such partial tubes are contemplated in the current invention.

Once the plurality of tubes of hierarchically varying diameters are manufactured, they are nested one within the other, and affixed together into a single solid concentrically nested cylindrical structure via a suitable bonding technique (Step 2 in FIG. 1A). For example, the tubes may be joined together with an epoxy resin, or via another suitable technique and material, such as those disclosed, for example, in U.S. Pat. Nos. 4,983,943; 5,086,554; and 6,331,363, the disclosures of which are incorporated herein by reference.

Figure 1C:
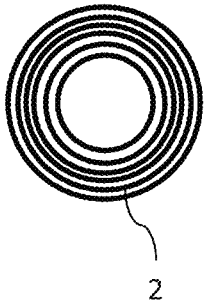
Figure 1D:
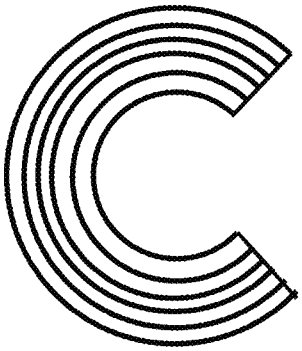
Figure 1E:
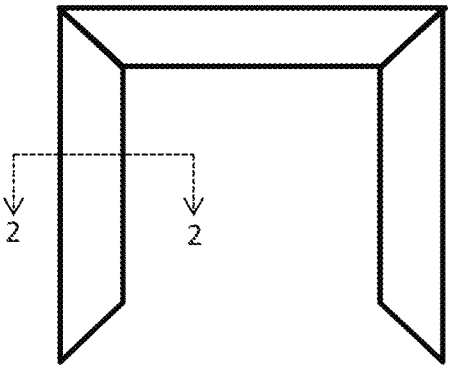
Figure 1F:
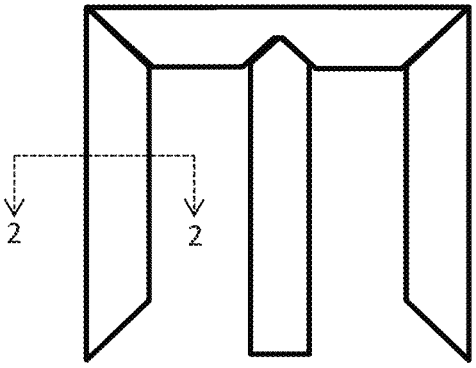

Finally, once the concentrically nested hollow tube is formed, the tube is sectioned via a suitable cutting technique to form the desired core shape (Step 3 in FIG. 1A). Although in FIGS. 1A and 1C the concentrically nested hollow tube is sectioned perpendicular to the central axis to form "I" shape cylindrical cores, it should be understood that that the core may be sectioned in any geometry suitable to form the core shape desired, such as in a "C" shape (as shown in FIG. 1D). For example, as shown in FIGS. 1E and 1F, the nested tube 1 may be sectioned at an angle to the central axis such that the sectioned tube elements can be bonded at the sectioned faces to form various core shapes of tubular cross section 2. In one exemplary embodiment, for example, the section angle is 45° such that the sectioned tube elements can be bonded (such as via epoxy resin as described above) at the sectioned faces to form a "U" shape (as shown in FIG. 1E) or an "E" shape (as shown in FIG. 1F) core of tubular cross section.

In short, cores of many different geometries may be made in accordance with the current invention. Moreover, owing to the individual cell units being bulk tubes (wall thickness >0.5 mm) rather than two-dimensional ribbons (thickness <100 μm), a much more efficient fabrication process will be possible due to the limiting the number of assembly steps necessary to achieve a desirable outer diameter. Moreover, the cores are expected to be of higher efficiency, as greater packing densities can be achieved in this method.

Although the above has focused on ferromagnetic cores themselves and their manufacture, it will be understood that these magnetic cores may be used in any electrical, magnetic, and electromagnetic device, which involves generation, transmission, and conversion of electrical power. Exemplary electronic devices that can incorporate the present inventions are any devices that have power components or supplies, including portable, mobile, hand-held, or miniature consumer electronic devices. Illustrative electronic devices can include, but are not limited to, music players, video players, still image players, game players, other media players, music recorders, video recorders, cameras, other media recorders, radios, medical equipment, calculators, cellular phones, other wireless communication devices, personal digital assistances, programmable remote controls, pagers, laptop computers, printers, or combinations thereof. Miniature electronic devices may have a form factor that is smaller than that of hand-held devices. Illustrative miniature electronic devices can include, but are not limited to, watches, rings, necklaces, belts, accessories for belts, headsets, accessories for shoes, virtual reality devices, other wearable electronics, accessories for sporting equipment, accessories for fitness equipment, key chains, or combinations thereof. Some exemplary consumer electronics embodiments can be found at U.S. patent application Ser. Nos. 12/700,518, 11/302,907, and 11/235,873; and U.S. Pat. Nos. 4,130,862, 5,528,205, 7,166,795 and 7,583,500, the disclosures of each of which are incorporated herein by reference.

With respect to such consumer electronic devices, the amorphous ferromagnetic cores of the instant invention allow smaller, lighter and more energy efficient designs in many high frequency applications for invertors, ASD (Adjustable speed drives), and power supplies. In particular, amorphous metals have higher permeability due to the lack of crystalline magnetic anisotropy. As such, amorphous magnetic cores have superior magnetic characteristics, such as lower core loss, when compared with conventional crystalline magnetic materials, and because the cores of the instant invention allow for the construction of thicker denser cores improving the packing density and efficiency of the cores, and, in turn, the power conversion and storage components incorporating the inventive cores.

EXEMPLARY EMBODIMENTS

The person skilled in the art will recognize that additional embodiments according to the invention are contemplated as being within the scope of the foregoing generic disclosure, and no disclaimer is in any way intended by the foregoing, non-limiting examples.

Example 1

Formation of Bulk Tubes by Quartz Water Quenching

Figure 2:
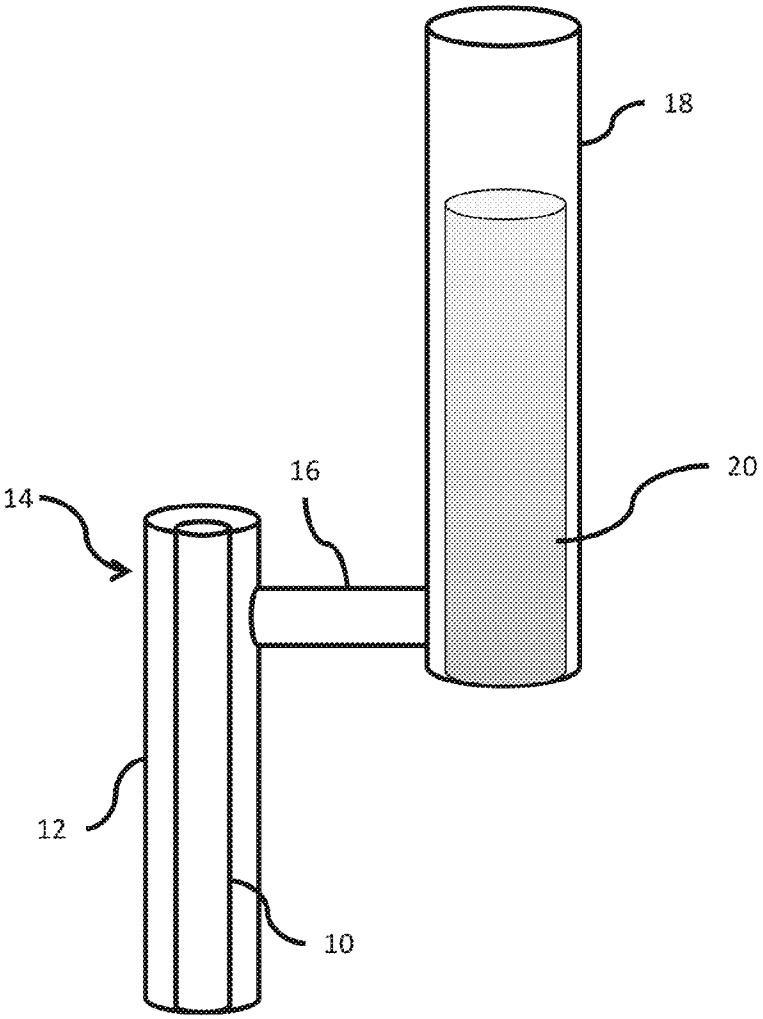
FIG. 2 presents a quartz tube assembly that could form an amorphous tube by the quartz-tube quenching method in accordance with the current invention.

In one exemplary embodiment, a 50-mm long quartz tube of 4-mm inner diameter and 5-mm outer diameter (10) is joined concentrically with a 50-mm long quartz tube of 7-mm inner and 8-mm outer diameter (12) to form a tubular cavity of 5-mm inner diameter and 7-mm outer diameter (14). The cavity is connected (16) to a quartz tube of 10-mm inner diameter and 12-mm outer diameter (18), in which the initial alloy ingot (20) is placed (see FIG. 2). The quartz tube assembly containing the alloy ingot is evacuated and placed in a furnace set at a temperature sufficiently above the melting temperature of the alloy. Once the alloy is homogeneously melted, argon pressure is applied to drive the molten alloy into the tubular cavity. After filing the tubular cavity, the quartz tube assembly is rapidly quenched in cool water to form a 50-mm long 1-mm thick amorphous tube of 5-mm inner diameter and 7-mm outer diameter.

Example 2

Formation of Bulk Tubes by Copper Mold Casting

Figure 3:
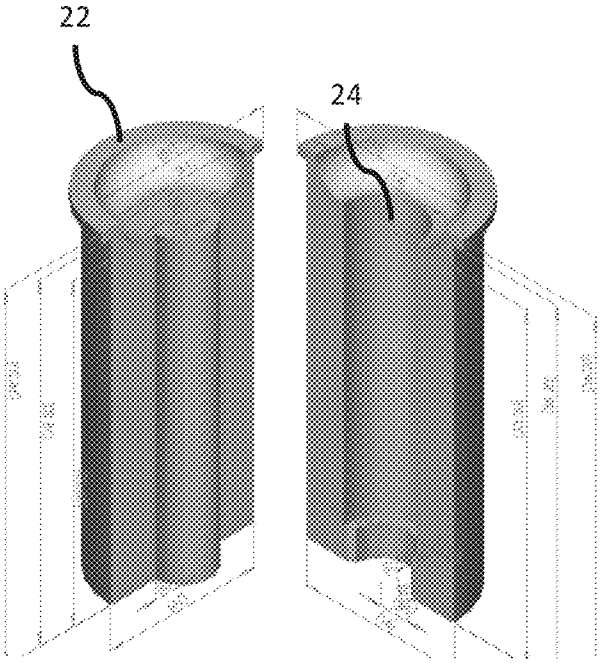
FIG. 3 presents a copper mold that could form an amorphous half tube by the copper-mold casting method in accordance with the current invention.

A split copper mold (22) with a half-tube cavity (24) of 6-mm inner diameter, 8-mm outer diameter, and 33.2-mm length was fabricated (see FIG. 3). In using such a mold, the alloy ingot is placed on top of the mold and is melted in argon atmosphere by plasma arc. Once the alloy is homogeneously melted, suction is applied from the bottom of the mold to drive the molten alloy into the cavity to form a 33.2-mm long 1-mm thick amorphous half tube of 6-mm inner diameter and 8-mm outer diameter (see FIG. 3).

Example 3

Exemplary Charging Tower

Figure 4:
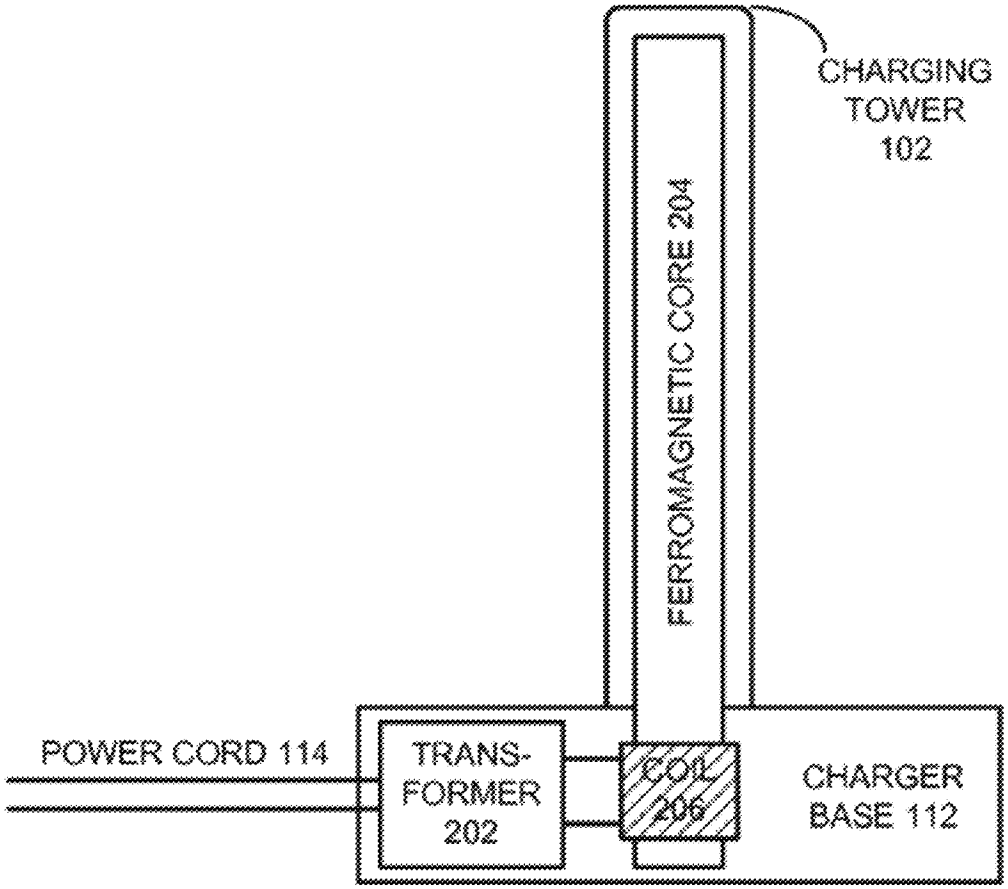
FIG. 4 presents an exemplary embodiment of the ferromagnetic core in accordance with the current invention integrated within a consumer electronic device.

In one embodiment, the ferromagnetic cores of the instant invention could be integrated into a consumer electronics device that generates, converts and transmits electrical power, such as an inductive charging tower. FIG. 4 (obtained from U.S. patent application Ser. No. 12/700,518) illustrates the structure of a charging tower 102 in accordance with the disclosed embodiments. Note that charging tower 102 is coupled to a charger base 112, which supports charging tower 102 and contains a transformer 202 and a transmitting coil 206. During operation, transformer 202 receives power through a power cord 114, which is coupled to a wall socket. Transformer 202 converts the voltage of the A/C power received from the wall socket and uses the resulting voltage to drive transmitting coil 206.

The transmitting coil 206 is wrapped around a ferromagnetic core 204, which runs the length of charging tower 102. A time-varying current flowing through transmitting coil 206 creates a varying magnetic flux in ferromagnetic core 204, which creates a time-varying magnetic field through a receiving coil that is wrapped around charging tower 102. This time-varying magnetic field induces a time-varying current in the receiving coil. Next, the time-varying current in the receiving coil is used to charge the associated electronic device. Note that using a ferromagnetic core in accordance with the current invention would improve the magnetic flux and hence improve the charging efficiency of the charging tower.

Although this exemplary embodiment demonstrates the potential integration of the ferromagnetic cores of the instant invention with a consumer electronic inductive charging tower device, it should be understood that the ferromagnetic cores of the invention could be integrated into any consumer electronic device in which a magnetic core is found, i.e., a consumer device that is power consuming, transforming or generating.

Example 4

Electronic Device Having Magnetic Latching Mechanism

Figure 5:
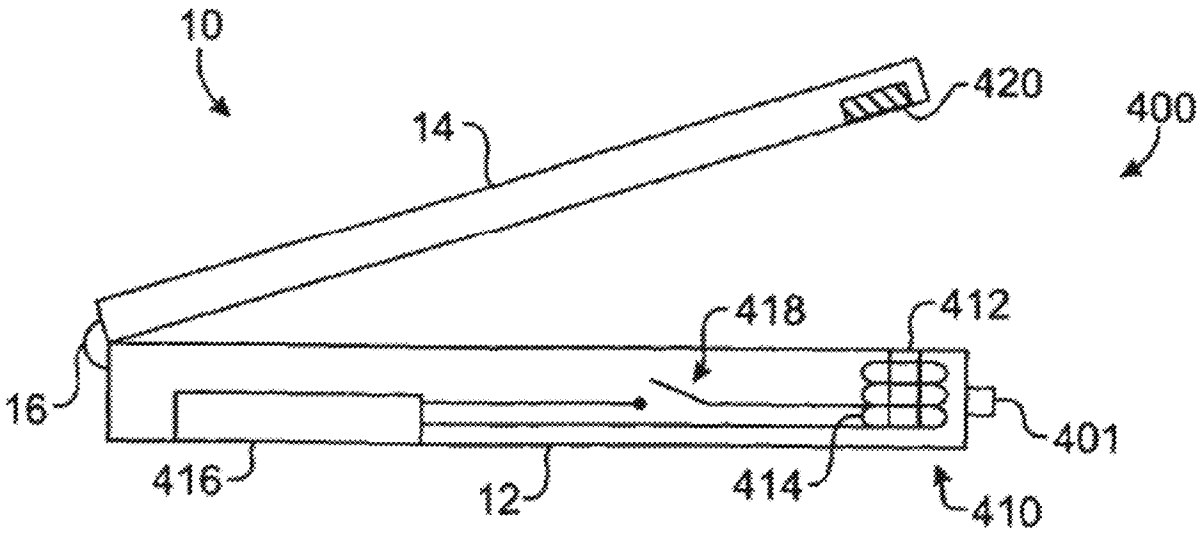
FIG. 5 illustrates an embodiment of the disclosed latch and pop-up mechanism having an electromagnet, a permanent magnet and an amorphous ferromagnetic core.

The amorphous ferromagnetic cores can be used in electronic device having magnetic latching mechanism. Referring to FIG. 5 (obtained from U.S. Pat. No. 7,583,500), an embodiment of a latch and pop-up mechanism 400 according to certain teachings of the present disclosure is illustrated in a side view. The mechanism 400 includes an electromagnet 410 positioned on the body 12 and includes a permanent magnet 420 positioned on the display 14. The electromagnet 410 has an amorphous ferromagnetic core 412 wrapped by a coil 414, which is connected to a power source or battery 416. In one embodiment, the power source or battery 416 is the same used to power the electronic device 10. Alternatively, the power source or battery 416 can be an independent supply of power to the electromagnet 410.

The electromagnet 410 operates in an energized condition to produce an open state and in an unenergized condition to produce a closed state. In the unenergized condition, internal electronics. (not all shown), which includes a switch 418 for connecting the coil 414 to the battery 416, cause the electromagnet 410 to be disconnected from the battery 416. Thus, the permanent magnet 420 on the display 14 is magnetically attracted to the ferromagnetic material of the core 412 and can maintain the display 14 closed against the body 12.

To produce the energized condition, the user pushes an external button 401 to activate the internal electronics (such as switch 418) and to connect the coil 414 to the battery 416. Current is supplied to the coil 414 to energize the core 412. When energized, the electromagnet 410 produces a polarity opposite to that of the permanent magnet 420 in the display 14 and causes the magnet 420 to be magnetically repulsed by the energized electromagnet 410. The repulsion thereby causes the display 14 to pop-up a distance to allow the user to open the display 14.

Example 5

Electronic Device Having Electromagnetic Connector

Figure 6A:
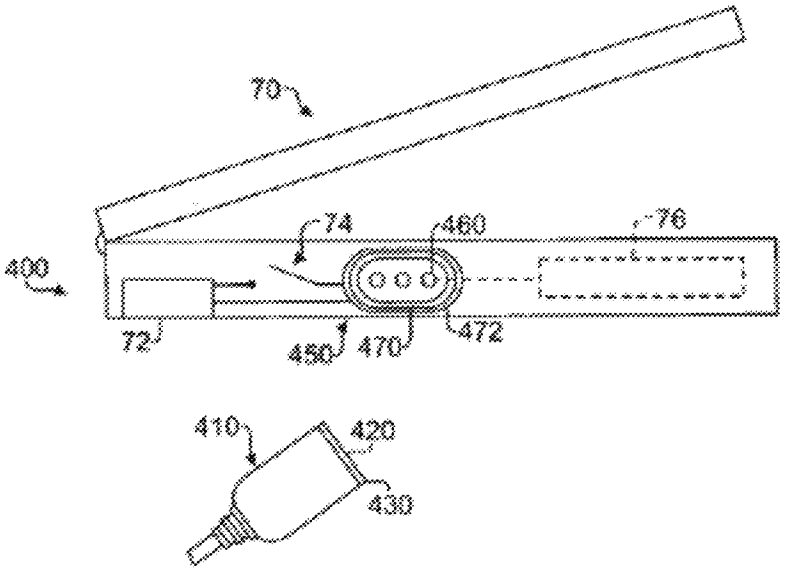
FIGS. 6A and 6B illustrate embodiments of magnetic connectors having electromagnets with amorphous ferromagnetic cores therein.

Referring to FIG. 6A (obtained from U.S. patent application Ser. No. 11/235,873), an embodiment of a magnetic connector 400 having an electromagnet is illustrated. The electromagnet could include a ferromagnetic core wrapped with a coil that is connectable to a power supply. The connector 400 includes a plug 410 and a receptacle 450. The plug 410 has contacts 420 for conveying power from a transformer (not shown) and has a magnetic element 430, which can be a ferromagnetic material. The receptacle 450 has contacts 460 for conveying power to internal electronics 76 of the device 70, which is a laptop computer in the present embodiment.

The receptacle 450 has an electromagnet formed by a metal core 470 made of an amorphous ferromagnetic material wrapped by a wire coil 472. Using an electromagnet in the plug 410 or receptacle 450 can overcome some of the disadvantages of having a permanent magnet on either the plug 410 or receptacle 450. For example, the electromagnet may reduce potential interference with internal components of the electronic device 70 or storage media.

The coil 472 is connected to a power supply or battery 72 of the laptop 70, and an internal switch 74 among other electronics can be used to operate the electromagnet of the core 470 and coil 472. The internal switch 74 causes power from the battery 72 to energized the electromagnet of core 470 and coil 472. Consequently, the energized electromagnet produces a magnetic field that attracts the ferromagnetic material 430 of the plug 410 and that can hold the plug 410 to the receptacle 450. The battery 72 can be an independent battery of the device or can be the same battery used to power the internal electronics 76 of the device 70. In either case, operation of the internal switch 74 and other electronics for connecting the battery 72 to the electromagnetic is preferably controlled to conserve power consumption of the battery 72.

Figure 6B:
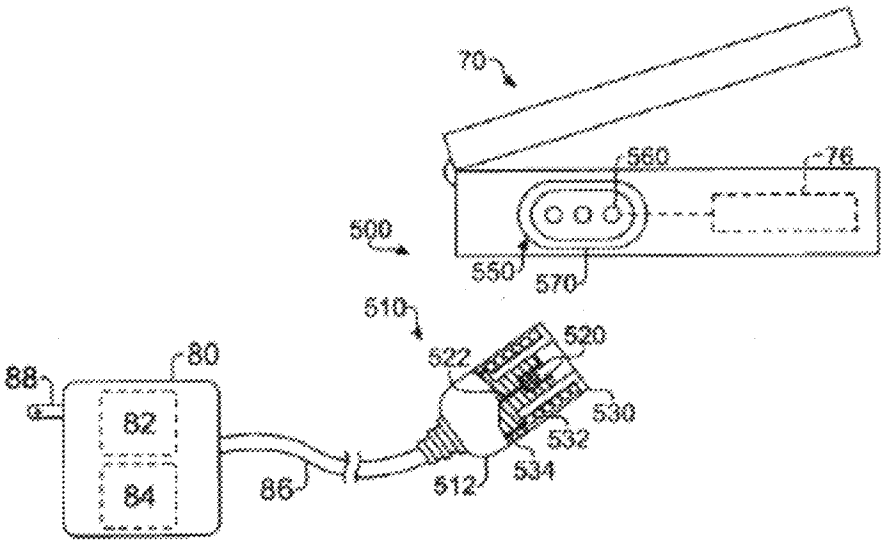

Referring to FIG. 6B, another embodiment of a magnetic connector 500 having an electromagnet is illustrated. The connector 500 includes a plug 510 and a receptacle 550. The receptacle 550 has contacts 560 for conveying power and signals to internal electronics 76 of the device 70. The receptacle 550 also has a magnetic element 570, which can be an amorphous ferromagnetic material. The plug 510 has contacts 520 for conveying power and signals from a power supply, such as power adapter 80, via wires 522 of a cable 86. The plug 510 has an electromagnet formed by a metal core 530 made of an amorphous ferromagnetic material wrapped by a wire coil 532. The coil 532 is connected to a power supply by wires 534. For example, the coil 532 can draw power output from the transformer 82 of the adapter 80, form a conventional power supply to which the outlet plug 88 connects, or from a battery 84 housed internally in the adapter 80. Use of the battery 84 can overcome the need for a user to first connect the adapter 80 to the power supply before the electromagnet in the plug 510 is operated and can magnetically connect to the receptacle 550. The drawn power energizes the electromagnet of core 530 and coil 532 to produce a magnetic attraction to the ferromagnetic material 570 that can hold the plug 510 to the receptacle 550.

Example 6

An Electronic Keyboard

Figure 7A:
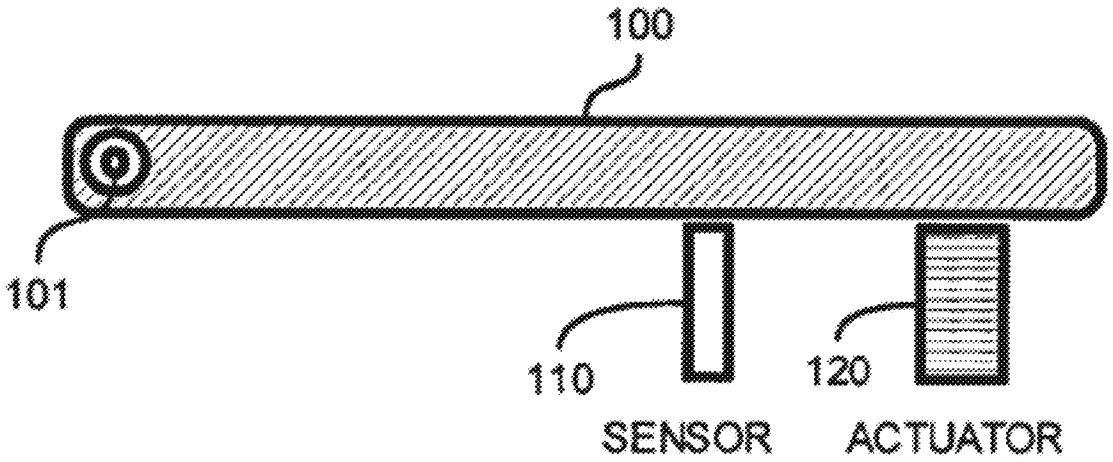
FIGS. 7A and 7B illustrate two implementations of a key with a sensor and actuator in accordance with embodiments of the invention.
Figure 7B:
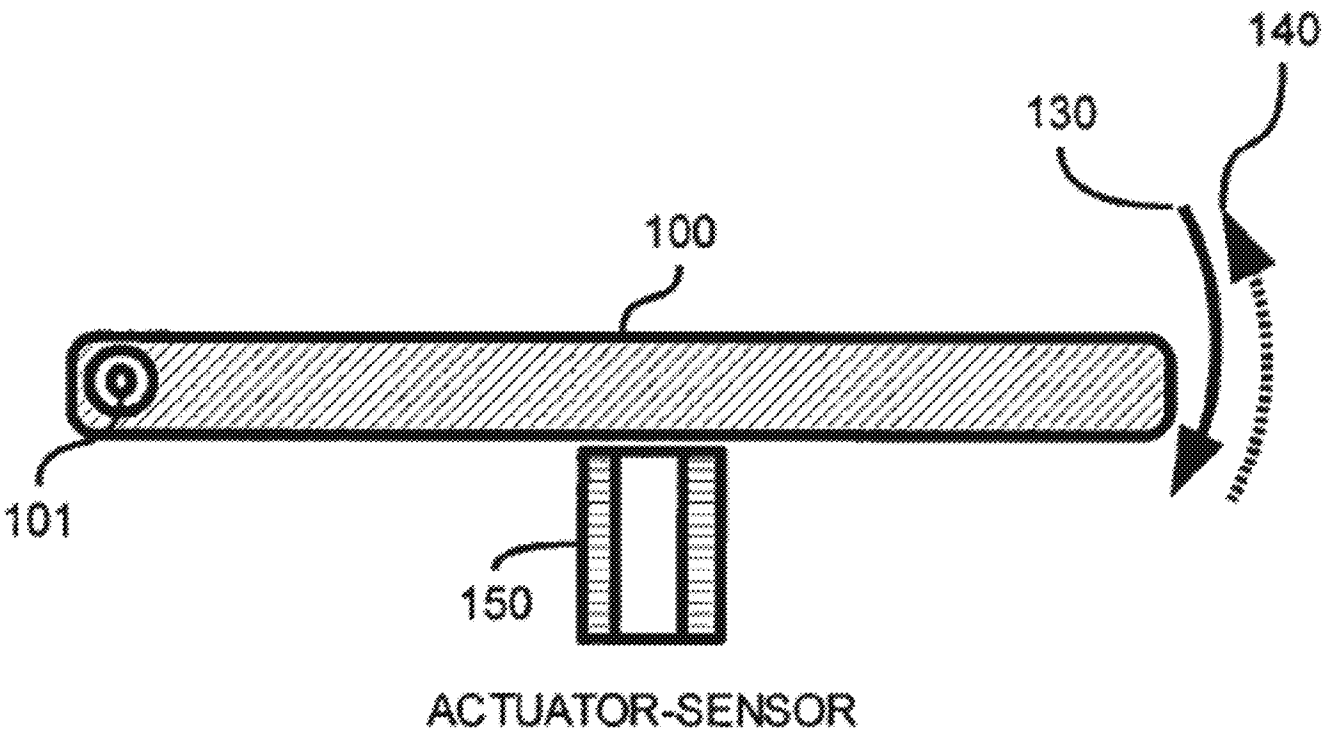

FIGS. 7A and 7B (obtained from U.S. Pat. No. 7,166,795) illustrate the implementation of electromechanical devices in accordance with one or more embodiments of the invention. FIG. 7A depicts a key 100 of a keyboard separately coupled with a sensor 110 and an actuator 120. The keyboard key 100 is also coupled with a support system through a coupling 101. The support coupling may be as simple as a connecting axis (as exemplified in FIGS. 7A and 7B) to allow the key to rotate about the axis. The coupling may also comprise mechanical elements configured to allow for translation movements (e.g. as in a grand piano) or any other key movements required to properly emulate a mechanical keyboard or generate specific mechanical properties sought by the keyboard player.

In embodiments of the invention, one or more motion sensing devices 110 may be placed in the vicinity of each key. For example, an optical encoder sufficient to capture the range of rotation about the hinge axis may be implemented at any point along the key structure. Similarly, a magnet may be attached to the key at any point, with one or more magnetic sensors placed in a corresponding arc adjacent to the magnet location. The motion sensing devices may be configured to sense any or all of the kinetic properties of the key movement. For example, a sensing device or a combination thereof may capture the data for position, velocity and acceleration.

Sensor 10 typically comprises a transducer that allows for converting captured mechanical data into electrical signals. Sensor 10 may further comprise an analog-to-digital converter for converting analog electrical signals into digital data that can be transmitted to and processed by a digital processor, for example. Embodiments of the invention may utilize any available static and kinetic data capturing device.

The keyboard key 100 is also coupled with one or more actuators 120. An actuator may be any device capable of receiving a signal (e.g. electrical or optical signal) and producing a mechanical action. One example of an actuator is an electromagnet that comprises a core (e.g. an amorpohous ferromagnetic rod) and a conductive coil. Embodiments may utilize any actuator available in the industry to provide movement control of the key 100 such as pneumatic, piezoelectric actuators or any other actuator available.

Embodiments of the invention may also utilize one or more actuators to control the translation movement, as mentioned above, to emulate a specific type of mechanical behavior.

Embodiments of the invention may utilize actuators that implement electronic circuitry to control movement. For example, the actuator may comprise one or more electronic circuits capable of executing a variety of actions based on input (e.g., drive current) to the circuit. Actuators may also comprise a digital processor, memory and embedded instructions (or computer programs). In one or more embodiments of the invention, an actuator may receive direct input from one or more sensors. Furthermore, actuators may receive input from sensors located on the same key, and from sensors located on adjacent or distant keys on the keyboard.

FIG. 7B depicts an arrangement of a key and an actuator-sensor device in accordance with one or more embodiments of the invention. The actuator-sensor 150 may be a combined device that allows for sensing movement and producing force. For example, the actuator-sensor device 150 may be an electromagnet that induces electric current when the core is moved through the coil, and produces movement of the core when electric current is passed through the conductive coil. By measuring and controlling the value of the current passing through the conductive coil, embodiments of the invention may use an electromagnet, solenoid or similar device as a combined actuator-sensor device. For example, when a keyboard player presses a key down producing movement 130, a sensor or the sensing portion of an actuator-sensor device captures the static and dynamic data of the key to convey it to an electronic circuit or to a digital processor. For instance, the induced current, resulting from an amorphous ferromagnetic core attached to the key being forced backward through the solenoid coil, may be detected by sensing the current in the conductive coil and subtracting out the known contribution from the most recent control current. The remaining current is caused by the depression of the key, and may be used to compute a new output value for the control current. The actuator control output of the electronic circuit or the digital processor is transmitted to one or more actuators to provide a force 140. The force may move the key or simply provide a controlled resistance to simulate the desired key action.

DOCTRINE OF EQUIVALENTS

Those skilled in the art will appreciate that the foregoing examples and descriptions of various preferred embodiments of the present invention are merely illustrative of the invention as a whole, and that variations in the steps and various components of the present invention may be made within the spirit and scope of the invention. Accordingly, the present invention is not limited to the specific embodiments described herein but, rather, is defined by the scope of the appended claims.

What is claimed is:

1. A ferromagnetic core comprising a plurality of tubes of hierarchically varying diameters, each of the plurality of tubes having a wall thickness of at least 0.5 mm, the tubes being bonded together to form a concentrically nested hollow cylinder, and being formed of an amorphous metal alloy having a Curie-point temperature above room temperature.

2. The ferromagnetic core of claim 1, wherein the core is a section of the concentrically nested hollow cylinder taken perpendicular to the central axis of the cylinder such that core has a cylindrical geometry.

3. The ferromagnetic core of claim 1, wherein the core is a plurality of sections of the concentrically nested hollow cylinder taken at an angle to the central axis of the cylinder.

4. The ferromagnetic core of claim 3, wherein the plurality of sections are bonded together to form a unitary core having a tubular cross-section.

5. The ferromagnetic core of claim 4, wherein the plurality of sections are taken at an angle of 45 degrees to the central axis core to form a unitary core having a tubular cross-section and a geometry selected from the group consisting of U-shaped, E-shaped, C-shaped, and I-shaped, or combinations thereof.

6. The ferromagnetic core of claim 1, wherein the alloy comprises at least one metal selected from the group consisting of Fe, Co and Ni.

7. The ferromagnetic core of claim 6, wherein the alloy contains B, and at least one of Si and P.

8. The ferromagnetic core of claim 6, wherein the alloy contains at least one of Mo and Nb.

9. The ferromagnetic core of claim 6, wherein the alloy comprises at least 60 atomic percent of at least one metal selected from the group consisting of Fe, Co and Ni.

10. The ferromagnetic core of claim 1, wherein the alloy has a composition selected from the group consisting of $Fe_{70}Ni_5Mo_5P_{12.5}C_5B_2$, $Fe_{69}Ni_4Co_2Mo_5P_{12.5}C_5B_{2.5}$, $Fe_{68}Ni_2Co_5Mo_5P_{12.5}C_5B_{2.5}$, $Fe_{73}Ni_3Mo_4P_{11.5}C_5B_{2.5}Si_1$, and $Fe_{68}Ni_3Co_5Mo_4P_{11.5}C_5B_{2.5}Si_1$.

11. The ferromagnetic core of claim 1, wherein the alloy exhibits at least one of the following properties: a saturation magnetization of at least 1 T, a coercive field of less than 500 Nm, a remanent magnetization of less than 0.001 T, and a notch toughness, measured by bending a 2 mm diameter rod containing a notch with length of about 1 mm and root radius of about 0.1 mm, of at least 40 $MPa \cdot m^{1/2}$.

12. A method of forming a ferromagnetic core comprising:

forming a plurality of tubes of hierarchically varying diameters, each of the plurality of tubes having a wall thickness of at least 0.5 mm of an amorphous metal alloy having a Curie-point temperature above room temperature;

bonding the hollow tubes together to form a concentrically nested hollow cylinder; and sectioning said cylinder to form a core having a tubular cross-section.

13. The method of claim 12, wherein the hollow cylinder is sectioned perpendicular to the central axis of the cylinder such that core has a cylindrical geometry.

14. The method of claim 12, wherein the hollow cylinder is sectioned at an angle to the central axis of the cylinder.

15. The method of claim 14, wherein a plurality of sections are taken form the cylinder and the plurality of sections are bonded together to form a unitary core having a tubular cross-section.

16. The method of claim 14, wherein the cylinder is sectioned at an angle of 45 degrees to the central axis core; and wherein the plurality of section are bonded to form a unitary core having a tubular cross-section and a geometry selected from the group consisting of U-shaped, E-shaped, C-shaped, and I-shaped, or combinations thereof.

17. A consumer electronic device comprising:

a ferromagnetic core comprising a plurality of tubes of hierarchically varying diameters, each of the plurality of tubes having a wall thickness of at least 0.5 mm, the tubes being bonded together to form a concentrically nested hollow cylinder, and being formed of an amorphous metal alloys having a Curie-point temperature above room temperature.

18. The consumer electronic device of claim 17, wherein the core is a section of the concentrically nested hollow cylinder taken perpendicular to the central axis of the cylinder such that core has a cylindrical geometry.

19. The consumer electronic device of claim 17, wherein the core is a plurality of sections of the concentrically nested hollow cylinder taken at an angle to the central axis of the cylinder.

20. The consumer electronic device of claim 19, wherein the plurality of sections are bonded together to form a unitary core having a tubular cross-section.

21. The consumer electronic device of claim 20, wherein the plurality of sections are taken at an angle of 45 degrees to the central axis core to form a unitary core having a tubular cross-section and a geometry selected from the group consisting of U-shaped, E-shaped, C-shaped, and I-shaped, or combinations thereof.

* * * * *